United States Patent [19]

Coffman

[11] 4,099,893

[45] Jul. 11, 1978

[54] PUMP WITH ELECTRICALLY ACTUATED FLOW CONTROL

[75] Inventor: Jerry L. Coffman, Colfax, Ind.

[73] Assignee: TRW Inc., Cleveland, Ohio

[21] Appl. No.: 736,732

[22] Filed: Oct. 29, 1976

[51] Int. Cl.[2] ..... F04B 49/08

[52] U.S. Cl. ..... 417/300; 251/250; 251/282; 417/310

[58] Field of Search ..... 417/300, 302, 308, 304, 417/310; 60/468, 494

[56] References Cited

U.S. PATENT DOCUMENTS

| | | | |
|---|---|---|---|
| 2,730,130 | 1/1956 | Guidry | 251/250 X |
| 3,095,903 | 7/1963 | Jennings | 251/250 X |
| 3,182,596 | 5/1965 | Prijatel | 417/310 X |
| 3,495,539 | 2/1970 | Tomita et al. | 417/310 |

*Primary Examiner*—Carlton R. Croyle
*Assistant Examiner*—R. E. Gluck

[57] ABSTRACT

A pump unit comprises a housing defining a pumping chamber, a fluid inlet and a fluid outlet communicate with the pumping chamber. A pair of cooperating gear members are located in the pumping chamber to pump fluid from the inlet to the outlet. A pintle member and a valve seat are located in the outlet and an electric motor is provided for moving the pintle member relative to the valve seat. The pintle member and valve seat comprise a variable orifice. The pump unit also includes a bypass valve for bypassing fluid from the outlet to the inlet to thereby control flow of fluid to the system. The amount of fluid which is bypassed is controlled by a spool valve member which is movable in response to forces acting thereon. The spool valve member is acted upon by the pressure drop across the variable orifice. Thus, by adjusting the size of the orifice, the position of the spool valve can be controlled and as a result the amount of flow to the system can be controlled. The spool valve member has one end face which is acted upon by the pressure on one side of the orifice and there are flow passages in the housing communicating the pressure on the other side of the orifice to a pilot pressure chamber located at the other end of the spool valve. A pilot valve is carried by the spool valve and that pilot valve opens in response to a pressure increase in the pilot pressure chamber exceeding a predetermined value. When the pilot valve opens, pressure in the pilot pressure chamber is vented to inlet. A means in the form of a small passage leading to the pilot pressure chamber restricts the rate of buildup of fluid in the chamber during relief of pressure in the chamber opening the pilot valve. As a result the valve spool moves from a flow control position to a pressure relief position in order to bypass more fluid from the outlet of the pump to the inlet of the pump.

4 Claims, 5 Drawing Figures

PUMP WITH ELECTRICALLY ACTUATED FLOW CONTROL

BACKGROUND AND SUMMARY OF THE PRESENT INVENTION

The present invention relates to a pump unit, and particularly relates to a variable flow pump unit. Specifically, the present invention relates to a pump unit where the flow to a device or system supplied by the pump can be controlled by adjustment of a variable orifice in the outlet of the pump.

It is known that flow from a pump to a fluid device or system can be controlled by providing a variable orifice in the system between the pump and the device and controlling the flow from the pump by sensing the pressure drop across that orifice and effecting bypass of fluid from the pump outlet to the pump inlet in accordance with the pressure drop. Thus, by adjusting the orifice, pump output is changed and flow to the device or system is varied.

The present invention is directed to a compact, practical pump unit including a variable orifice, bypass valve and pump. Further, and more specifically, in accordance with the present invention, by adjustment of the variable orifice, the amount of fluid which is bypassed from the outlet of the pump to the inlet of the pump by the bypass valve is controlled and thereby the amount of fluid that flows to the system is controlled. Further, since the bypass valve responds to pressures acting thereon from opposite sides of the orifice, the bypass valve will shift in order to attempt to maintain a fixed output from the pump to the system being supplied with fluid by the pump.

Further, in accordance with the present invention, the bypass valve functions to relieve excessive pressures in the nature of a pressure relief valve. The bypass valve comprises a spool valve which has one end face which is acted upon by the pressure immediately downstream of the pumping elements (upstream of the variable orifice). The other end of the spool valve is exposed to pressure in a pilot pressure chamber which is communicated with pressure on the downstream side of the variable orifice. Accordingly, the spool valve moves in response to pressure changes on opposite sides of the variable orifice in an effort to maintain the fixed output from the pump.

In addition, the spool valve carries a pilot valve which communicates with the pilot pressure chamber. When the pressure in the pilot pressure chamber exceeds a predetermined value, the pilot valve moves to an open position, and communicates the pilot pressure chamber to the pump inlet. As a result, the pressure in this pilot pressure chamber is reduced. Further, the passage leading from downstream of the variable orifice to the pilot pressure chamber is constructed such that it restricts the rate of pressure buildup in the pilot pressure chamber when the pilot pressure chamber is vented by opening of the pilot valve. As a result, the pressure in the pilot pressure chamber is significantly reduced when the pilot valve opens and the spool will move to a pressure relief position by the force of the outlet pressure acting thereagainst. As a result, a significant amount of fluid will be bypassed from the outlet to the inlet for purposes of pressure relief. Once the conditions which created the excessive pressure are overcome, the spool valve will immediately return to its flow control position for purposes of maintaining the fixed output from the pump unit.

DESCRIPTION OF THE FIGURES

Further features of the present invention will be apparent from the description of the preferred embodiment of the present invention made with reference to the accompanying drawings in which.

DESCRIPTION OF THE PREFERRED EMBODIMENT

Figure 1:
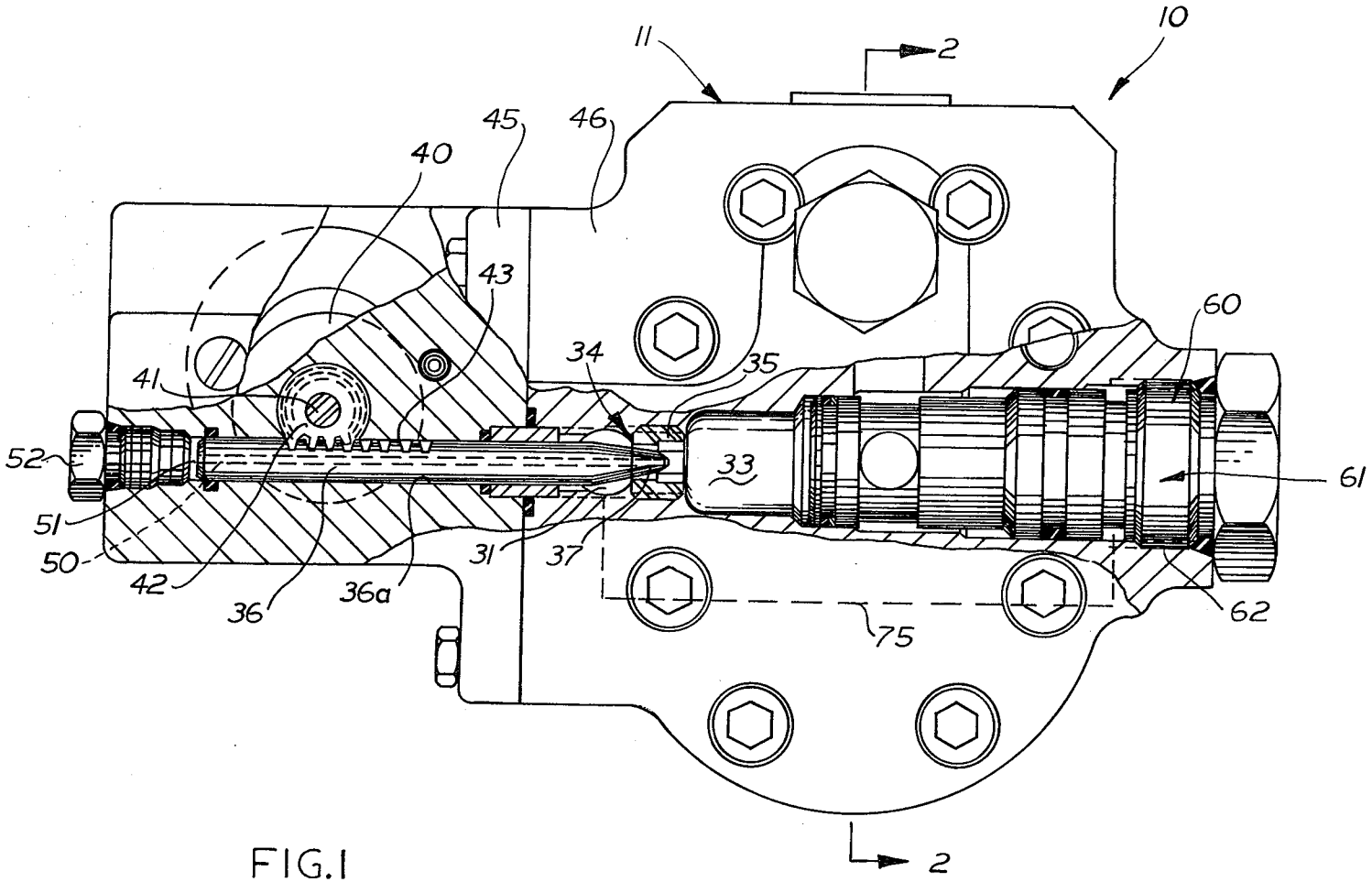
FIG. 1 is an elevational view, partly in section, of a pump unit embodying the present invention.

As noted hereinabove, the present invention relates to a pump unit for providing a controlled output flow to hydraulic devices or a hydraulic system. The pump unit of the present invention is a practical compact structure and incorporates suitable control valves for purposes of controlling the flow of fluid to the devices supplied by the pump. For purposes of illustration only, a pump unit embodying the present invention is shown in the drawings and is designated 10.

The pump unit 10 includes a housing 11 which defines a pumping chamber 12. A gear pump mechanism is located in the pumping chamber 12 and comprises a pair of gear members 13, 14. The gear member 14 is drivingly connected to an input shaft 15 which is supported by suitable bearings 16 and 17 located in the housing 11. The gear member 13 meshes with the gear member 14 and is likewise supported in suitable bearings 18 and 19 for rotation relative to the housing 11. The specific structure of the gear pump and bearings and seals may take a variety of different forms and will not be described in detail since these elements are not important to the present invention.

Figure 2:
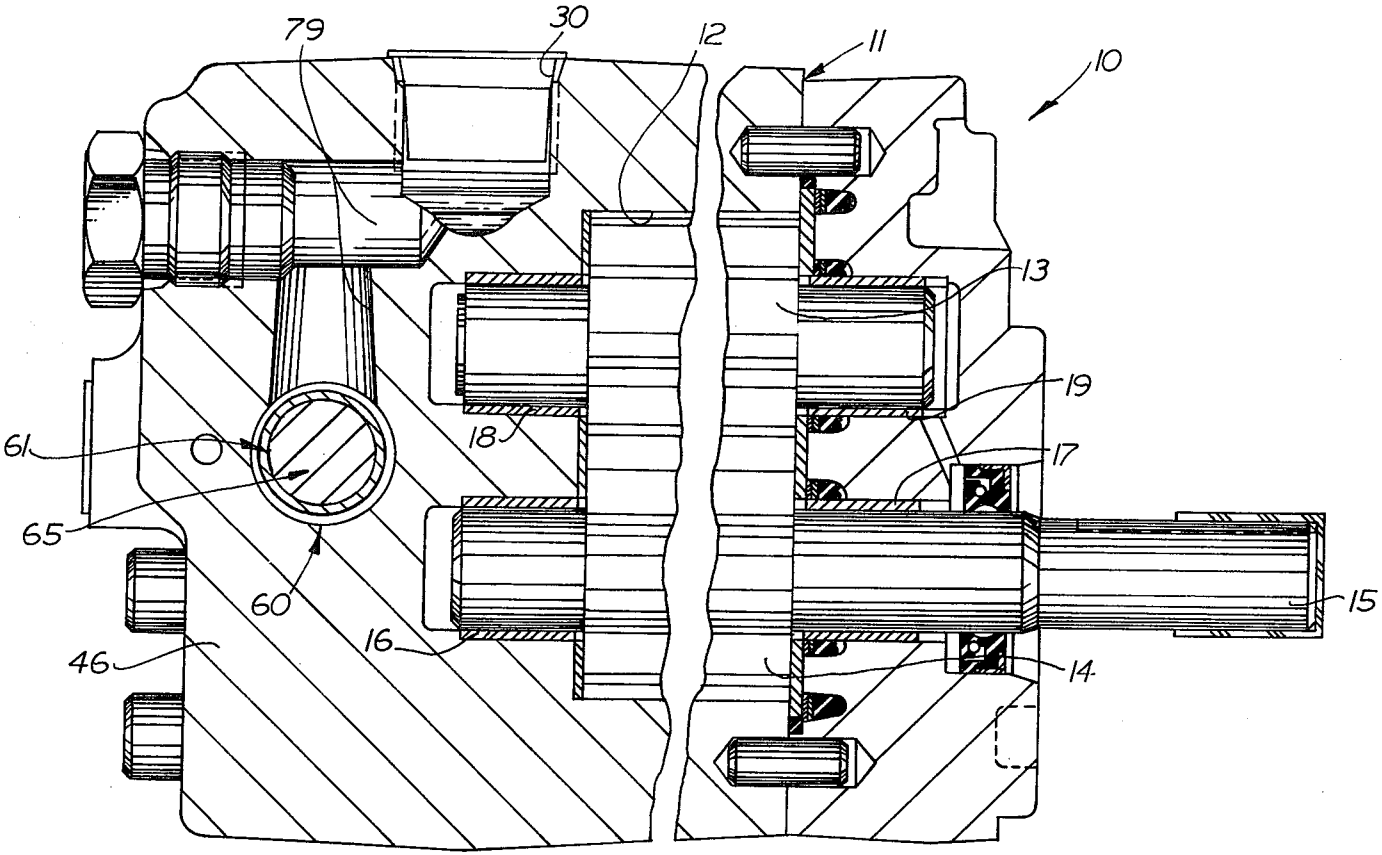
FIG. 2 is a sectional view, taken approximately along the line 2—2 of FIG. 1.

The pumping chamber 12 communicates with a pump inlet port 30 by passages, not shown. As the gear members 13 and 14 rotate, fluid is drawn from the inlet port 30 and pumped through an outlet port 31, best shown in FIG. 2. The flow from the gear members 13 and 14 initially is directed into a chamber 33 and from the chamber 33 the flow passes through a variable orifice 34 and then into the outlet port 31. For purposes of this specification, the chamber 33 and passages therefrom including the port 31 are termed the pump outlet.

Accordingly, the variable orifice 34 is located in the pump outlet. The variable orifice 34 is defined by a valve seat 35 which is threadedly received in the housing 11 and by a pintle valve member 36 which has a tapered nose 37. The nose portion 37 and the valve seat 35 define the orifice 34 therebetween which may be varied in size by movement of the pintle member 36 relative to the valve seat 35. By varying the size of the orifice 34, the amount of flow to the system can be controlled, as will be apparent from the description hereinbelow.

The pump unit 10 embodying the present invention incorporates an electric motor 40 for moving the pintle valve member 36. The motor 40 is suitably secured to the housing 11. The electric motor 40 has an output shaft 41 and a suitable gear 42 attached in a driving relation to the output shaft 41. The gear 42 meshes with a rack 43 formed on the pintle valve 36. Upon energization of the electric motor 40, the pintle valve 36 is moved in a bore 36a contained in the housing 11 and is positioned relative to the valve seat 35.

As best illustrated in FIG. 1, the housing 11 includes a housing part 45 on which the electric motor is mounted. The housing part 45 is suitably secured to the main housing part 46 of the pump unit 10. The housing part 45 at least in part defines the bore 36a in which the pintle valve 36 is located. The pintle valve 36 extends into the main housing portion 46 and the variable orifice 34 is located therein.

In order that the pintle valve may be accurately positioned by the electric motor, the pintle valve 36 is provided with a hole 50 axially extending through the pintle valve. The pintle valve 36 at its left end is exposed to a chamber 51 which is closed by a suitable plug 52. The hole 50 provides for balancing the fluid pressures on the two ends of the pintle valve 36 and accordingly the position of the pintle valve is controlled exclusively by the energization of the electric motor 40.

While the pintle valve 36 and valve seat 35 comprise the variable orifice 34, the pintle valve 36 can be moved into position in engagement with the valve seat 35. As a result, all flow of fluid from the pump through outlet port 31 is blocked. The operation of the unit when this occurs is described hereinbelow.

Figure 3:
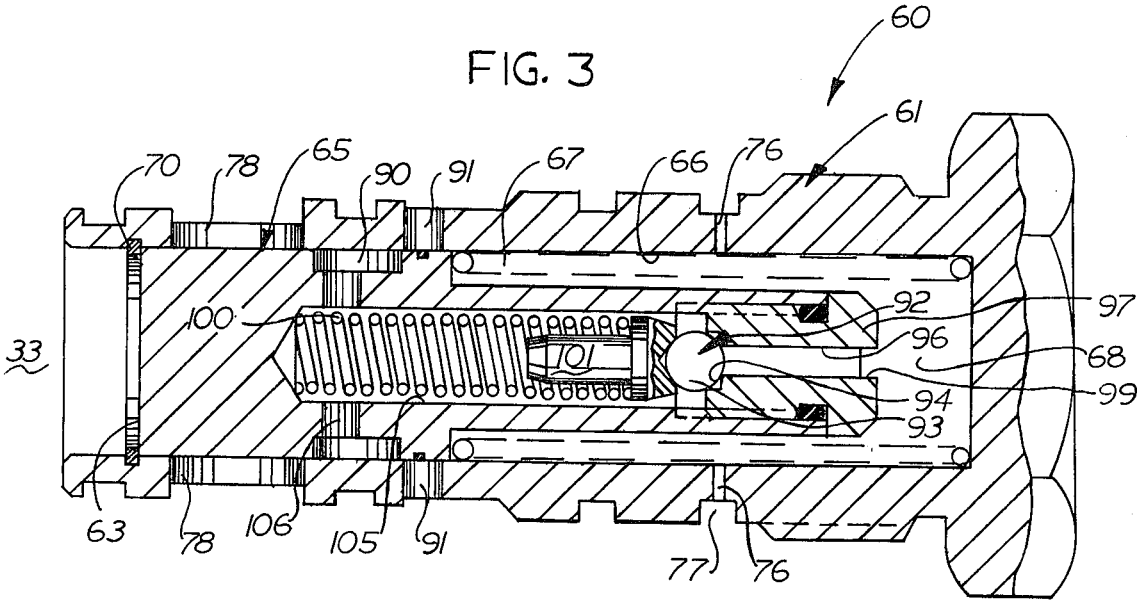
FIGS. 3, 4 and 5 are sectional views of the combination bypass and pilot valve structure, which is incorporated in the pump unit of FIG. 1, showing the parts in different positions.

The pump unit 10 includes a bypass valve structure designated 60. The bypass valve structure 60 controls the flow of fluid to the system in accordance with the position of the pintle valve 36. The bypass valve 60 includes a cartridge 61 which is threaded at 62 into the housing 11. The bypass valve 60 further includes a spool valve member 65 which is located in a bore 66 in the cartridge 61. As shown in FIG. 3, the left end face 63 of the spool 65 communicates with the outlet chamber 33 and accordingly outlet pressure acts on the face 63 of the spool valve 65. A spring 67 is located in a chamber 68 at the right end of the spool valve 65, as viewed in the drawings, and biases the spool valve 65 toward the left. When the pump is inoperative, the spool valve 65 will have the position shown in FIG. 3 in which the spool valve 65 engages a snap ring 70 against which it is biased by the spring 67.

As the pump begins operating, fluid pressure in the chamber 33 will act against the face 63 of the spool valve. Further, a pressure tap, formed by passages designated 75 in the housing (see FIG. 1), communicates the pressure from downstream of the variable orifice, namely, the pressure in the outlet port 31, to the chamber 68. The passage 75 communicates with an annulus 77 formed in the outer periphery of the cartridge 61. Restricted passages 76 communicate the annulus 77 with the chamber 68. The passages 76 are relatively small, which should be noted, as their size becomes important to the description of the operation of the spool valve 65 below.

From the above, it should be apparent that the pressure drop across the variable orifice 34 is communicated to the spool valve 65 and acts across the spool valve 65. Specifically, the pressure in the chamber 33 (upstream of orifice 34) acts directly on the face 63 of the spool valve; whereas the pressure on the downstream side of the orifice 34 is communicated to the chamber 68 and acts on the right end surfaces as viewed in the drawings of the spool valve. Accordingly, the spool valve 65 will move in the bore 66 in dependence upon the pressure drop which occurs across the variable orifice 34.

Figure 4:
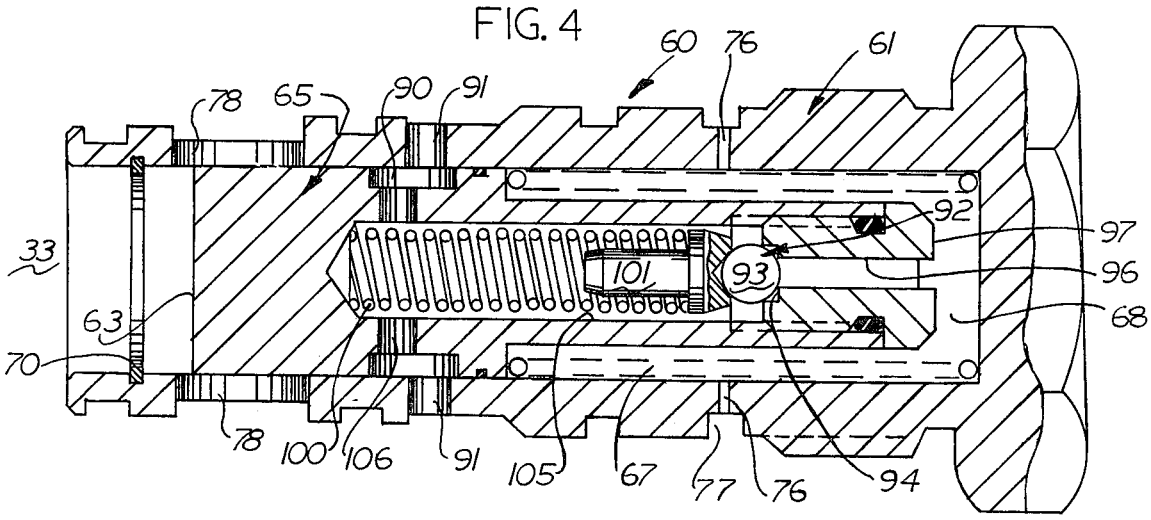

For example, as shown in FIG. 4, the spool valve is shown in a position in which the spool valve 65 has moved to a position where the chamber 33 communicates with passages 78 in the cartridge member 61. The passages 78 communicate with the inlet to the pump by passages 79, shown in FIG. 2, and accordingly when the spool valve 65 is in the position shown in FIG. 4, fluid is bypassed from the outlet of the pump, specifically chamber 33, to the inlet of the pump via the passages 78, 79. The amount of fluid which is bypassed depends upon the position of the spool valve 65, and the position of the spool valve 65 in turn depends upon the forces acting thereon, namely, the spring 67 and the pressure drop across the variable orifice 34. Accordingly, by adjusting the position of the pintle valve 36 and thus the size of the variable orifice 34, the amount of fluid that flows to the device or system supplied by the pump unit 10 can be varied.

It should be noted that the position of the spool valve 65 shown in FIG. 4 is typical of the control positions which the spool valve may take. In such control positions, fluid is bypassed from outlet to inlet and thus flow to the device or system supplied by the pump unit is controlled.

In addition, when the spool valve 65 is in the position illustrated in FIG. 4, the spool valve 65 has an annular groove 90 which communicates with other openings 91 in the cartridge 61. The openings 91 also communicate with the inlet of the pump by passages not shown.

Further, the spool valve 65 carries a pilot valve 92 which is in the form of a ball valve 93 which seats against a valve seat 94. The ball 93 closes an axial opening 96 which extends axially of a plug member 97, which is threaded into the end of the spool valve 65 and forms a part thereof. The passage 96 communicates with the chamber 68. The ball valve 93 is biased against the valve seat 94 by a spring 100 which engages a plug 101, which in turn engages the left side of the ball valve 93 and positions the ball relative to the valve seat 94.

When the pressure in the chamber 68 exceeds a predetermined value which is sufficient to overcome the bias of the spring 100, the ball valve 93 will move to an open position away from the valve seat 94, thereby causing opening of the pilot valve 92. When the pilot valve 92 opens, the pressure in chamber 68 reduces due to the fact that the chamber 68 communicates through passage 96 and passage 105 and radial openings 106 with the groove 90 in the spool valve 65. The groove 90 in turn communicates with the pump inlet through the openings 91.

When the pressure in chamber 68 reduces due to opening of the pilot valve 92, the valve spool 65 moves to the right, as shown in the drawings. This occurs due to the fact that the openings 76 are of small size and restrict the rate of buildup of pressure in the pilot pressure chamber. Since the pressure in the pilot pressure chamber 68 exhausts at a very high rate and the buildup of pressure through openings 76 is at a lesser rate, the valve spool 65 will move to the right. For example, if excessive pressure is encountered when the valve spool 65 is in a flow control position, such as shown in FIG. 4, the spool valve 65 will move to a pressure relief position from the flow control position.

In the relief position, the right end of the spool valve 65 contacts the head end of the cartridge 61, and substantially all of the pump output is bypassed to inlet through opening 78. Due to a slot 99 in the right end of the spool valve 65, pressure in chamber 68 is communicated to ball 93 even though the spool valve abuts the head end of the cartridge 61. The pressure relief position of the spool valve 65 is shown in FIG. 5, which also shows the pilot valve 92 in open position.

When the excessive pressure condition is overcome and relieved, the ball valve 93 will move to its closed position relative to the seat 94 and the pressure in chamber 68 will build up causing the spool valve 65 to move back to its flow control position as determined by the position of the pintle valve 36.

Figure 5:
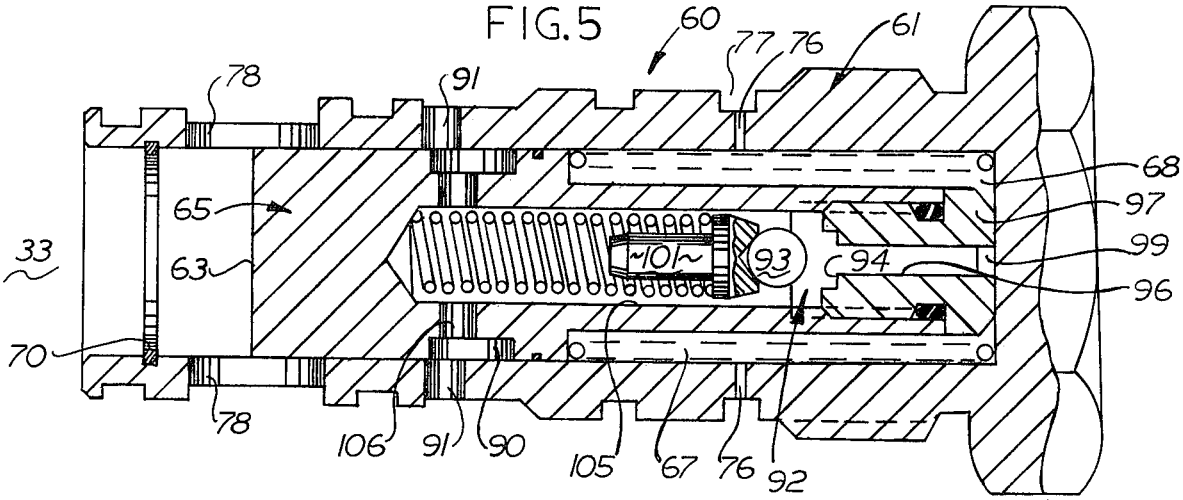

In the event that the pintle valve 36 is moved to a position in contact with the valve seat 35, pressure in chamber 33 will increase and that pressure will force the spool 65 to move to the pressure relief position shown in FIG. 5.

Accordingly, it should be apparent from the description above that the present invention provides a new and improved pump unit which is of practical impact construction and where flow control and pressure relief are provided.

Having described my invention, I claim:

1. A pump unit comprising a housing defining a pumping chamber, a fluid inlet and a fluid outlet in said housing communicating with said pumping chamber, a pair of cooperating gear members in said pumping chamber for pumping fluid from said inlet to said outlet, means supported in said housing defining a variable orifice in said outlet, said means defining said variable orifice including a part of a pintle member and a valve seat, means supporting said pintle member for movement relative to said valve seat to control the size of the variable orifice, an electric motor supported on said housing for moving said pintle member relative to said valve seat to control the size of said orifice, a flow control valve in said housing for bypassing fluid from said outlet to said inlet, said flow control valve including a spool valve member located in a bore in said housing and which is movable therein, said spool valve member being positionable between a first position blocking communication between said inlet and outlet and a full relief second position providing maximum communication between said inlet and outlet to control bypassing of fluid from said outlet to said inlet, a spring biasing said spool valve member into said first position blocking communication between said inlet and outlet, said spring being located in chamber means at one end of said spool valve member, said spool valve member having one face surface acted upon by the pressure on one side of said orifice, said spool being movable by the pressure on one side of the orifice to said full pressure relief second position or a flow control position intermediate said first and second positions, flow passages in said housing communicating the pressure on the other side of said orifice to said chamber means, a pilot valve carried by said spool valve and which opens in response to pressure in said chamber means exceeding a predetermined value, passage means to said inlet communicating the pressure in said chamber means to inlet upon opening of said pilot valve, and means for restricting the rate of pressure build-up in said chamber means during relief of the pressure in said chamber means by opening of said pilot valve to cause said spool valve to move from a flow control position to said full pressure relief second position, said means for restricting pressure build up comprising a restricted portion of said flow passages and said passage means to said inlet having a substantially greater cross-sectional area throughout its extent than said restricted portion of said flow passage.

2. A pump unit as defined in claim 7 wherein said housing comprises one housing part supporting said electric motor and a second housing part defining said pumping chamber, said one housing part defining a bore in which said pintle valve is movable, and said variable orifice being located within said second housing part.

3. A pump unit as defined in claim 2 wherein said pintle valve comprises an elongated valve member and means for balancing the pressure on the fluid acting on the opposite ends thereof.

4. A pump unit as defined in claim 3 wherein said pintle valve has a rack formed therein and said electric motor drives a gear which meshes with said rack to position said pintle valve.

* * * * *